US007021223B2

(12) United States Patent
Meyer et al.

(10) Patent No.: US 7,021,223 B2
(45) Date of Patent: Apr. 4, 2006

(54) METHOD AND APPARATUS FOR INJECTING GASIFICATION MEDIUM INTO PARTICLE-LOADED GASIFICATION SPACES

(75) Inventors: Bernd Meyer, Freiberg (DE); Reinhard Skoddow, Hoyerswerda (DE); Osman Turna, Frankfurt (DE)

(73) Assignees: Sekundarrohstoff-Verwertungszentrum Schwarzw Pumpe GmbH, Spreetal (DE); Envirotherm GmbH, Essen (DE)

( * ) Notice: Subject to any disclaimer, the term of this patent is extended or adjusted under 35 U.S.C. 154(b) by 0 days.

(21) Appl. No.: 10/643,271

(22) Filed: Aug. 19, 2003

(65) Prior Publication Data

US 2004/0052691 A1 Mar. 18, 2004

(30) Foreign Application Priority Data

Sep. 13, 2002 (DE) ..... 102 42 594

(51) Int. Cl.
*F23G 5/30* (2006.01)
*F23B 7/00* (2006.01)

(52) U.S. Cl. ..... 110/341; 110/266; 110/243; 48/197 R

(58) Field of Classification Search ..... 110/266, 110/260, 261, 207, 262, 263, 264, 265, 243, 110/244, 245, 346, 165 R, 347; 431/7, 170; 48/197 R, 77, 73, 89, 126; 422/139, 145, 422/187

See application file for complete search history.

(56) References Cited

U.S. PATENT DOCUMENTS 3,207,202 A * 9/1965 Lingl ..... 431/161
3,302,596 A * 2/1967 Zinn ..... 431/284
4,043,766 A * 8/1977 Gernhardt et al. ..... 48/73
4,352,675 A * 10/1982 Seipenbusch et al. ..... 48/73
4,508,040 A * 4/1985 Santen et al. ..... 110/347
4,564,389 A * 1/1986 Yamaoka et al. ..... 75/492
5,335,608 A * 8/1994 Dehn et al. ..... 110/264

* cited by examiner

*Primary Examiner*—Kenneth Rinehart
(74) *Attorney, Agent, or Firm*—Norris McLaughlin & Marcus PA

(57) ABSTRACT

Method and apparatus for injecting gasification medium into particle-loaded gasification spaces of fixed-bed, fluidized-bed or entrained-bed gasifiers by means of gasification-medium nozzles, wherein the supply portion the isorate of the gasification medium in the gasification-medium nozzle does not fall below a minimum value, and in the adjoining acceleration portion the gasification medium is constantly accelerated and upon exit from the nozzle orifice is concentrated in a focus.

8 Claims, 2 Drawing Sheets

METHOD AND APPARATUS FOR INJECTING GASIFICATION MEDIUM INTO PARTICLE-LOADED GASIFICATION SPACES

This invention relates to a method and an apparatus for injecting gasification medium into particle-loaded gasification spaces of fixed-bed, fluidized-bed or entrained-bed gasifiers by means of gasification-medium nozzles.

BACKGROUND OF THE INVENTION

Gasification medium (GM), which by means of gasification-medium nozzles (GM nozzles) is injected into particle-loaded gasification spaces of fixed-bed, fluidized-bed or entrained-bed gasifiers, frequently consists of a vapor/oxygen mixture (GM mixture). Beside pure vapor/oxygen mixtures other GM mixtures are also used, e.g. by admixing air, $CO_2$ and other usable gases. The GM nozzles are designed both as externally cooled and as uncooled one-component nozzles. From the multitude of gasification processes, the British Gas/Lurgi slag bath gasification process (BGL gasifier) should subsequently be selected, by means of which the fact of injection can be represented particularly clearly in its complexity.

A vapor/oxygen mixture with a mixing ratio of about 1 kg vapor/$Nm^3$ oxygen is injected into the BGL gasifier. The GM nozzles are inclined downwards against the horizontal. The GM jet leaving the GM nozzles is directed onto the surface of the slag bath in the bottom portion of the BGL gasifier. When operated as specified, the GM mixture reacts with coke carbon particles and other oxidizable components present in the reaction space in direct vicinity in front of the nozzle orifice and releases heat due to combustion reactions. In the developing air-blast tuyere of the BGL gasifier, temperatures up to more than 2000° C. are usually obtained. At these temperatures, the slag is present as low-viscosity liquid.

The nozzle head protruding into the reaction space of the BGL gasifier is cooled intensively to avoid slag accretions and to protect against metal oxidation. The outer contours of the GM nozzles are designed to be compact and save surface area, in order to keep working surfaces for slag and the introduction of heat into the GM nozzles as low as possible.

The GM nozzles are designed as one-component nozzles. To definitely prevent slag or carbonaceous components from entering the GM nozzle through the cylindrical nozzle orifice and from impeding or blocking the nozzle exit, the gasification medium (GM) is blown out from the nozzle orifice at rather high speed. Under nominal load of the BGL gasifier, the GM exit rate is about 60 to 180 m/s. The higher the GM exit rate, the higher the risk of particles being sucked back into the GM nozzle. The nozzle orifices are clogged and finally block the exit of gasification medium. Disturbed nozzles are detected by measuring a low flame intensity and a decrease in the amount of gasification medium reaching the nozzle. Largely clogged or even blocked, so-called "black" nozzles must be shut off for safety reasons. This leads to performance losses up to the premature shut-down of the BGL gasifier. Experience has shown that frequently a plurality of nozzles go "black" at the same time or in quick succession, must be shut off, and thus necessitate the shut-down of the BGL gasifier before long. To fortify the GM nozzles, the BGL gasifier must be cooled and drained. This leads to long downtimes with considerable losses of output and high maintenance costs. In practical operation, the BGL must repeatedly be shut off due to the ingress of slag and carbonaceous material into the GM nozzles, in particular under unstable operating conditions and during start-up processes.

An essential safety criterion for the operation of the BGL gasifier is the assurance of an undisturbed, regular outflow of the gasification medium from the GM nozzles, which can only be ensured by absolute cleanliness of the inner nozzle contour of the GM nozzle in direct vicinity of the nozzle orifice. An undisturbed jet exit generally is accompanied by the undisturbed and uniform formation of a flame in front of the nozzle. An undisturbed, free formation of a jet is the best guarantee that the oxygen discharged reacts directly in front of the nozzle, is not deflected and does not get into colder regions of the BGL gasifier or to the ceramic brick lining unreacted. So far, there are no solutions to this problem.

What turns out to be particularly critical is the increased failure frequency of the GM nozzles during the gasification of heterogeneous waste substance mixtures in the BGL gasifier, the gasification and slag flow behavior of such mixtures being characterized by particularly strong irregularities. The following causes should be mentioned: extremely quickly variable slag viscosities and rapidly changing slag bath levels due to strong variations in the ash content and quality, very high and greatly varying temperatures in front of the nozzles due to the high and varying GM/coke ratio of the generally highly volatile waste substances, strong pressure pulsations in the air-blast tuyere in front of the nozzles.

The problems of the injection of gasification medium into particle-loaded gasification spaces, which were described with reference to the example of the BGL gasifier, similarly exist also for other gasification processes, such as the HTW fluidized-bed gasification. To solve these problems, very expensive two-component nozzles are used, which restrict the operational flexibility. The susceptibility to failure can likewise not be decreased to a sufficient extent.

As a result of the disadvantages of the prior art, it is the object of the invention to ensure a stable and uninterrupted supply of gasification medium (GM) into particle-loaded gasification spaces under all operating conditions and to ensure an undisturbed, uniform and intensive formation of a flame in front of the GM nozzles, even when using extremely hetereogeneous feedstocks, to avoid the clogging of GM nozzles, the shut-down of clogged GM nozzles and thus, in the final analysis, the premature shut-down of the gasifier.

SUMMARY OF THE INVENTION

For the solution of this object it is proposed to supply the gasification medium to the gasification space such that the flow rate of the gasification medium based on isothermal and isobaric conditions (GM isorate) in the GM supply tube up to shortly before the exit of the gasification medium from the nozzle orifice (supply portion) has a minimum value, and that the gasification medium in the adjoining last nozzle portion directly up to the exit of the gasification medium from the nozzle orifice (acceleration portion) is constantly accelerated and behind the nozzle orifice is concentrated in a focus, and that in cases in which liquid slag particles or a slag bath are present in the reaction space, in the last nozzle portion as seen in flow direction against the horizontal, the deepest GM flow thread is aligned to be inclined downwards or at best horizontally.

DETAILED DESCRIPTION

Maintaining the minimum GM isorates in the supply portion shortly before the exit of the gasification medium from the nozzle orifice serves to always protect the interior of the GM nozzle against the ingress of material. Under partial load, minimum GM isorates of 15 to 20 m/s should usually be maintained.

The invention furthermore is based on the knowledge that even under rough and unsteady operating conditions the acceleration of the GM flow in the acceleration portion allows a complete and safe avoidance of the introduction of disturbing matter into the GM nozzle up to maximum GM iso exit rates. The flow rests particularly tight against the inner contour of the acceleration portion directly up to the exit of the gasification medium from the GM nozzle at the nozzle orifice, so that no material can reach the inner nozzle wall, even if the nozzle immerges into the slag bath. The GM isorate is increased in the acceleration portion by 20 to 200%, preferably by 50 to 100%, the acceleration length being 0.5 to 3 times the diameter of the supply portion. The inventive acceleration of the GM isorate effects that under all operating conditions the GM nozzles are protected against the introduction of solids and hence against clogging or blocking.

By accelerating the gasification medium in the acceleration portion directly up to the nozzle orifice, focussing the GM jet in a jet focus (focus) a few millimeters in front of the nozzle orifice and hence a small negative pressure as compared to the pressure existing at the nozzle orifice can be achieved. Therefore, the cone angle of the acceleration portion preferably is defined to lie in the range from 5 to 20°. Slag and carbonaceous components reaching the nozzle orifice from outside are moved away from the nozzle orifice into the focus and from the same along with the GM jet on into the interior of the gasification space. Thereby, the formation of external accretions at the nozzle orifice is effectively prevented. By increasing the GM exit rate, the negative pressure in front of the GM nozzle and the extension of the negative pressure region, the introduction of carbon into the GM jet and hence the carbon conversion in front of the GM nozzles is increased. In the case of the presence of liquid slag or a slag bath in the gasification space, the constriction of the GM nozzle in the acceleration portion is also limited in that, as seen in flow direction against the horizontal, the deepest GM flow thread is aligned to be inclined downwards against the horizontal by 0 to 30°, preferably 5 to 15°, or at best horizontally. In accordance with the invention, this angular limitation ensures that upon immersion of the GM nozzle into the slag bath no slag can adhere in the interior of the nozzle. Moreover, no material can deposit in the GM nozzle even during downtimes.

The invention has a fundamentally advantageous effect for the gasification of difficult gasification substances, as is represented below with reference to the example of the BGL gasifier. For the first time, the GM nozzles remain free from clogging in continuous operation. Low to high GM flow rates are mastered easily.

The operational availability in time and the performance of the BGL gasifier are no longer restricted by clogging problems of the GM nozzles. Start-up and shut-down procedures are mastered even in complicated operating situations. The increase of the GM exit rate and the focussing of the jet lead to more uniform gasification processes in the air-blast tuyere and to a higher safety with respect to the undisturbed and uniform formation of a flame in front of the GM nozzle. Dangerous jet deflections, the advance of unreacted gasification medium into colder regions up to damages of the brickwork or other uncontrolled reactions are avoided.

Figure 1:
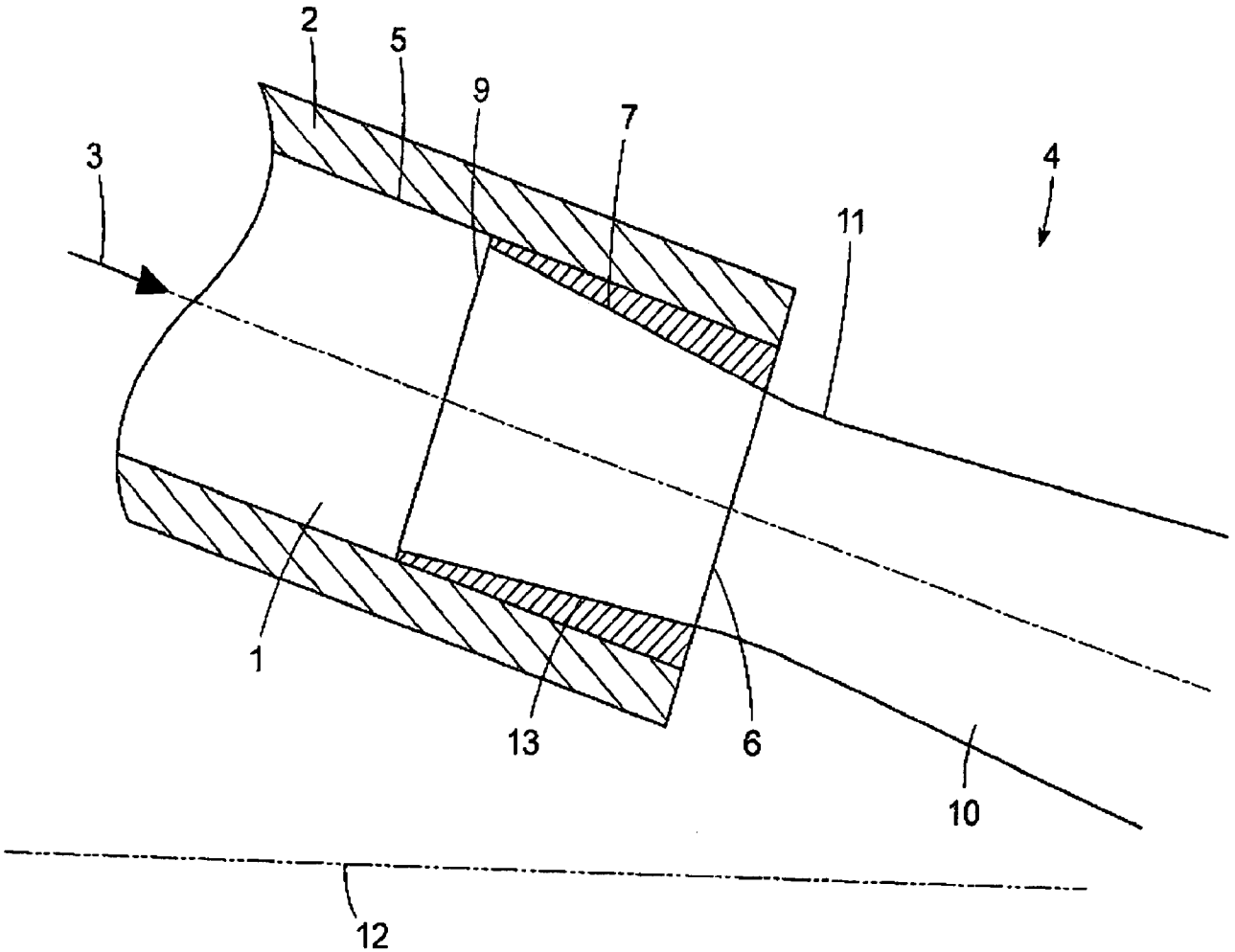
FIG. 1 illustrates the one component nozzle used in the method of the present invention, wherein the diameter at the beginning of the acceleration portion (7) is smaller than the diameter of the supply portion (5), and the deepest GM flaw thread (13) is aligned to be downwardly inclined.
Figure 2:
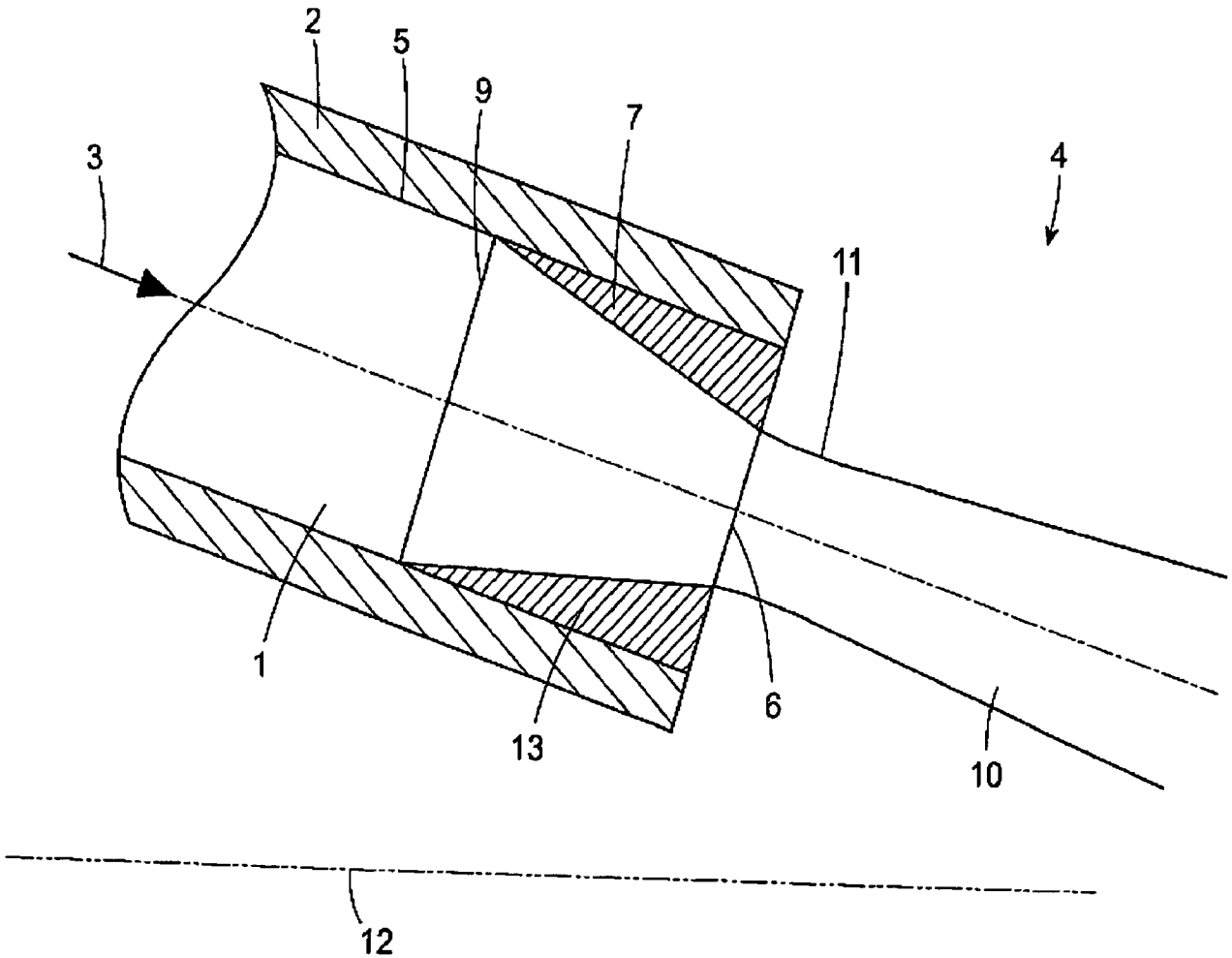
FIG. 2 illustrates the one component nozzle used in the method of the present invention, wherein the diameter at the beginning of the acceleration portion (7) is equal to the diameter of the supply portion (5), and the deepest GM flow thread (13) is aligned to be horizontally inclined.

In the drawings, the following reference numerals represent the following elements:

1 gasification-medium nozzle
2 gasification-medium supply tube
3 gasification-medium mixture
4 gas space
5 supply portion
6 nozzle orifice
7 acceleration portion
9 transition
10 jet of gasification medium
11 focus
12 horizontal
13 gasification medium flow thread

EXAMPLE

The invention will subsequently be explained in detail with reference to an embodiment. It describes the supply of gasification medium into an industrial BGL gasifier for gasifying extremely heterogeneous waste substances. The GM mixture supplied to the BGL gasifier via a total of 6 GM nozzles consists of 6,000 $Nm^3/h$ oxygen and 5,700 g/h vapor. The GM nozzles constitute one-component nozzles of circular nozzle cross-section. FIG. 1 shows a schematic representation of the section through the front end of the GM nozzle 1. The coaling jacket surrounding the GM supply tube 2 is not represented for simplicity. To the GM supply tube 2 GM mixture 3 is supplied with a temperature of 260° C. In the gas space of the air-blast tuyere 4 a pressure of 25 bar(a) and a mean temperature of 2,100° C. exist. In accordance with the invention, the inner nozzle contour consists of two portions, the cylindrical supply portion 5 and the acceleration portion 7 conically tapering towards the nozzle orifice 6, which acceleration portion constitutes a welded sleeve. The place where the acceleration portion 7 begins is referred to as transition 9. The transition 9 represents an abrupt reduction of the diameter from 25 to 24 mm. The GM mixture 3 flows through the supply portion 5 with a GM isorate of 104 m/s (300° C., 25 bar(a)). From the transition 9 up to the exit from the nozzle orifice 6, which has a diameter of 19 mm, the GM isorate is accelerated continuously in the acceleration portion 7. The GM jet 10 leaves the nozzle orifice 6 with a GM isorate of 179 m/s. The length of the acceleration portion is 23.8 mm, the cone angle hence is defined to be 6°. In front of the nozzle orifice 6, the acceleration of the GM jet 10 continues for a distance of a few millimeters and in the focus 11 reaches the maximum GM isorate and the lowest static pressure.

The axis of the GM nozzle 1 is inclined 20° downwards against the horizontal 12. The deepest GM flow thread 13 has a downward inclination against the horizontal 12 of 14°.

By realizing the above-described type of nozzle in the large-scale gasification plant, the object of the invention was solved in practice. The advantages of the invention with respect to the prior art were achieved in all stated points.

We claim:

1. A method of injecting gasification medium into particle-loaded gasification spaces of fixed-bed, fluidized-bed or entrained-bed gasifiers by one component GM nozzles, wherein said one component GM nozzle comprises a supply portion (5) and an adjoining acceleration portion (7) and in the supply portion (5) the GM isorate in the GM nozzle (1) does not fall below a minimum value of 15 to 20 m/s, and in the adjoining acceleration portion (7) the gasification medium is constantly accelerated and upon exit from the nozzle orifice (6) is concentrated in the focus (11).

2. The method as claimed in claim 1, wherein, in the case of the presence of liquid slag particles or a slag bath in the gasification space, the deepest GM flaw thread (13) in the acceleration portion (7), as seen in flow direction against the horizontal (12), is aligned to be horizontal or downwardly inclined.

3. The method as claimed in claim 1, wherein, in the acceleration portion (7) the GM isorate is constantly increased by 20 to 200%.

4. The method as claimed in claim 3, wherein said increase is 50 to 100%.

5. The method as claimed in claim 1, wherein the deepest GM flow thread (13) is inclined downwards by 0 to 30° against the horizontal (12).

6. The method as claimed in claim 5, wherein said incline is 5 to 10°.

7. A one-component GM nozzle for performing the method of claim 1, wherein the GM nozzle (1) consists of a tubular supply tube (2) with a supply portion (5) which merges into a conical acceleration portion (7), the length of the acceleration portion (7) being 0.5 to 3 times the inside diameter of the supply portion (5) and the diameter at the beginning of the acceleration portion (7) is smaller than the diameter of the supply portion (5).

8. The apparatus of claim 7, wherein the cone angle of the acceleration portion (7) is between 5 and 20°.

* * * * *